US011408309B2

(12) United States Patent
Ueda et al.

(10) Patent No.: US 11,408,309 B2
(45) Date of Patent: Aug. 9, 2022

(54) VALVE OPENING AND CLOSING TIMING CONTROL DEVICE

(71) Applicant: AISIN CORPORATION, Kariya (JP)

(72) Inventors: Kazuo Ueda, Kariya (JP); Yuji Noguchi, Kariya (JP); Masaki Kobayashi, Kariya (JP)

(73) Assignee: AISIN CORPORATION, Aichi (JP)

( * ) Notice: Subject to any disclaimer, the term of this patent is extended or adjusted under 35 U.S.C. 154(b) by 51 days.

(21) Appl. No.: 17/122,096

(22) Filed: Dec. 15, 2020

(65) Prior Publication Data

US 2021/0189918 A1 Jun. 24, 2021

(30) Foreign Application Priority Data

Dec. 24, 2019 (JP) ..... JP2019-233239

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34426* (2013.01); *F01L 2001/34463* (2013.01); *F01L 2800/01* (2013.01)

(58) Field of Classification Search
CPC ..... F01L 1/3442; F01L 1/047; F01L 1/053; F01L 2001/34426; F01L 2001/34463;
(Continued)

(56) References Cited

U.S. PATENT DOCUMENTS

2012/0055429 A1 3/2012 Nakamura et al.
2013/0319357 A1* 12/2013 Suzuki ..... F01L 1/344 123/90.17
2016/0017770 A1 1/2016 Kobayashi et al.

FOREIGN PATENT DOCUMENTS

JP 2012052486 A 3/2012
WO 2014192355 A1 12/2014

OTHER PUBLICATIONS

U.S. Appl. No. 17/110,416, filed Dec. 3, 2020, Kazuo Ueda.
(Continued)

*Primary Examiner* — Zelalem Eshete
(74) *Attorney, Agent, or Firm* — Buchanan Ingersoll & Rooney PC

(57) ABSTRACT

A valve opening and closing timing control device includes: a drive-side rotary body rotating synchronously with a crankshaft; a driven-side rotary body arranged coaxially with the drive-side rotary body and rotating integrally with a valve opening and closing camshaft; a fluid pressure chamber defined between the drive-side and driven-side rotary bodies; advance and retard chambers defined by partitioning the fluid pressure chamber; an intermediate lock mechanism selectively switches between a lock state and a lock release state; advance and retard flow paths allowing a flow of the working fluid to be supplied to and discharged from the advance and retard chambers; a control valve including a spool; and a phase control unit moving a position of the spool by controlling a power supply amount to the control valve to supply and discharge the working fluid to and from the advance and retard chambers to displace a relative rotation phase.

12 Claims, 9 Drawing Sheets

(58) Field of Classification Search
CPC ..... F01L 2001/34423; F01L 2001/3443; F01L 2001/0476; F01L 2001/34433; F01L 2001/34466; F01L 2001/34473; F01L 2800/01; F01L 2250/02; F01L 2820/04; F01L 2820/041; F01L 2820/043
See application file for complete search history.

(56) References Cited

OTHER PUBLICATIONS

U.S. Appl. No. 17/110,418, filed Dec. 3, 2020, Kazuo Ueda.
U.S. Appl. No. 17/110,416, filed Dec. 3, 2020, entitled "Valve Opening and Closing Timing Control Device", naming Kazuo Ueda et al. as inventors.
U.S. Appl. No. 17/110,418, filed Dec. 3, 2020, entitled "Valve Opening and Closing Timing Control Device", naming Kazuo Ueda et al. as inventors.

* cited by examiner

POWER SUPPLY AMOUNT: 0 ← → MAXIMUM

| | PA1 | PA 2 | PN | PB |
|---|---|---|---|---|
| ADVANCE CHAMBER | SUPPLY | SUPPLY | CUT OFF | DISCHARGE |
| RETARD CHAMBER | DISCHARGE | DISCHARGE | CUT OFF | SUPPLY |
| LOCK MECHANISM | DISCHARGE | SUPPLY | SUPPLY | SUPPLY |

0 ← POWER SUPPLY AMOUNT → MAXIMUM

| | PB1 | PB2 | PN | PA |
|---|---|---|---|---|
| ADVANCE CHAMBER | DISCHARGE | DISCHARGE | CUT OFF | SUPPLY |
| RETARD CHAMBER | SUPPLY | SUPPLY | CUT OFF | DISCHARGE |
| LOCK MECHANISM | DISCHARGE | SUPPLY | SUPPLY | SUPPLY |

VALVE OPENING AND CLOSING TIMING CONTROL DEVICE

CROSS REFERENCE TO RELATED APPLICATIONS

This application is based on and claims priority under 35 U.S.C. § 119 to Japanese Patent Application 2019-233239, filed on Dec. 24, 2019, the entire content of which is incorporated herein by reference.

TECHNICAL FIELD

This disclosure relates to a valve opening and closing timing control device that controls opening and closing timing of a valve.

BACKGROUND DISCUSSION

There is a valve opening and closing timing control device that sets a relative rotation phase to an intermediate lock phase between a most advanced phase and a most retarded phase when an engine is stopped (see WO 2014/192355 (Reference 1) and JP 2012-52486A (Reference 2)). In such a valve opening and closing timing control device, the intermediate lock phase to be locked when the engine is stopped can be set to a phase suitable for starting the engine. Therefore, the engine is started in a state where the intermediate lock phase is locked by a lock pin or the like. After the start is completed, oil pressure increases to an appropriate value due to an increase in an engine rotation speed (increase in an oil pump rotation speed), the lock pin then can be retracted to release the lock and feedback control can be performed to set the relative rotation phase to a target phase according to an engine operation state. Thereafter, when a lock request occurs when the engine is stopped or during an idle operation, the lock pin is protruded again to lock the relative rotation phase at the intermediate lock phase.

When an engine stall (hereinafter, also referred to as a "stall") occurs in a vehicle equipped with a valve opening and closing timing control device, the engine is stopped in a fairly short time without an engine stop command. Therefore, when the engine is stopped, the relative rotation phase may not be locked at the intermediate lock phase. In this case, startability at the time of restarting the engine is deteriorated.

The valve opening and closing timing control device in Reference 1 includes a control unit that instructs a solenoid valve to switch a supply destination of a working fluid to a supply destination of the working fluid in which a driven-side rotary body moves toward the intermediate lock phase when the relative rotation phase is located closer to the most retarded phase or the most advanced phase than the intermediate lock phase when the engine is started. Therefore, even when the relative rotation phase cannot be restrained to the intermediate lock phase when the engine is stopped, the relative rotation phase can be displaced to the intermediate lock phase when the engine is started, and good startability can be ensured.

The valve opening and closing timing control device ("variable valve timing control device" in the reference) in Reference 2 includes an engine stall prediction unit that predicts whether or not an engine stall occurs, and an engine stall control unit when it is predicted by the engine stall prediction unit that the engine stall occurs. The engine stall control unit sets a control amount of an oil pressure control valve regardless of the relative rotation phase to any one of a control amount for driving the lock pin in a lock direction, a control amount for driving the relative rotation phase in an advance direction, and a control amount for driving the lock pin in the lock direction and the relative rotation phase in the advance direction. With this configuration, in the valve opening and closing timing control device described in Reference 2, the relative rotation phase is moved to at least an advance side of the most retarded phase until the engine is stopped. Therefore, the engine is prevented from stopping in a state where the relative rotation phase is at the most retarded phase.

In the valve opening and closing timing control device in Reference 1, a phase control valve that controls the relative rotation phase and a lock control valve that controls an operation of the intermediate lock mechanism are provided separated from each other. These two control valves are solenoid valves. A structure that requires two solenoids is complicated. Further, it is necessary to separate a supply oil path from an oil pump from a phase control oil path and a lock control oil path, which makes the oil path configuration complicated.

In the valve opening and closing timing control device in Reference 2, when the engine stall is detected, the relative rotation phase is displaced in the advance direction regardless of whether the relative rotation phase is on the advance side or the retard side with respect to the intermediate lock phase. Therefore, when the engine stall occurs when the relative rotation phase is located, for example, between the intermediate lock phase and the most advanced phase, the relative rotation phase is not displaced toward the intermediate lock phase and the relative rotation phase is not changed to the intermediate lock phase. Therefore, in this case, the startability at the time of restarting the engine cannot be improved.

A need thus exists for a valve opening and closing timing control device which is not susceptible to the drawback mentioned above.

SUMMARY

A characteristic configuration of a valve opening and closing timing control device according to an aspect of this disclosure resides in that the valve opening and closing timing control device includes: a drive-side rotary body that rotates synchronously with a crankshaft of an internal combustion engine; a driven-side rotary body that is arranged coaxially with a rotation axis of the drive-side rotary body and that rotates integrally with a valve opening and closing camshaft of the internal combustion engine; a fluid pressure chamber defined between the drive-side rotary body and the driven-side rotary body; an advance chamber and a retard chamber defined by partitioning the fluid pressure chamber with a partition portion provided in at least one of the drive-side rotary body and the driven-side rotary body; an intermediate lock mechanism that selectively switches between a lock state in which a relative rotation phase of the driven-side rotary body with respect to the drive-side rotary body is restrained to an intermediate lock phase between a most advanced phase and a most retarded phase and a lock release state in which the restraint of the intermediate lock phase is released by supply and discharge of a working fluid; an advance flow path that allows a flow of the working fluid to be supplied to and discharged from the advance chamber; a retard flow path that allows a flow of the working fluid to be supplied to and discharged from the retard chamber; a control valve including a spool that is in a first position when a power supply amount is zero and is moved to a second position different from the first position when the power is supplied; and a phase control unit that moves a position of the spool by controlling the power supply amount to the control valve to supply the working fluid to and discharge the working fluid from the advance chamber and the retard chamber to displace the relative rotation phase. When the spool is in the first position, the intermediate lock mechanism is set to the lock state and a state in which the working fluid is discharged from any one of the advance chamber and the retard chamber and the working fluid is supplied to the other one of the advance chamber and the retard chamber. When the spool is in the second position, the intermediate lock mechanism is set to the lock release state and a state in which the working fluid is supplied to any one of the advance chamber and the retard chamber and the working fluid is discharged from the other one of the advance chamber and the retard chamber. When the intermediate lock mechanism is in the lock release state and the relative rotation phase is a phase that is displaced in a direction toward the intermediate lock phase when the power supply amount to the control valve is maximized, and if a rotation speed of the internal combustion engine becomes less than a predetermined value, the phase control unit controls the power supply amount to the control valve so that the relative rotation phase is displaced in the direction toward the intermediate lock phase.

A characteristic configuration of a valve opening and closing timing control device according to another aspect of this disclosure resides in that the valve opening and closing timing control device includes: a drive-side rotary body that rotates synchronously with a crankshaft of an internal combustion engine; a driven-side rotary body that is arranged coaxially with a rotation axis of the drive-side rotary body and that rotates integrally with a valve opening and closing camshaft of the internal combustion engine; a fluid pressure chamber defined between the drive-side rotary body and the driven-side rotary body; an advance chamber and a retard chamber defined by partitioning the fluid pressure chamber with a partition portion provided in at least one of the drive-side rotary body and the driven-side rotary body; an intermediate lock mechanism that selectively switches between a lock state in which a relative rotation phase of the driven-side rotary body with respect to the drive-side rotary body is restrained to an intermediate lock phase between a most advanced phase and a most retarded phase and a lock release state in which the restraint of the intermediate lock phase is released by supply and discharge of a working fluid; an advance flow path that allows a flow of the working fluid to be supplied to and discharged from the advance chamber; a retard flow path that allows a flow of the working fluid to be supplied to and discharged from the retard chamber; a control valve including a spool that is in a first position when a power supply amount is zero and is moved to a second position different from the first position when the power is supplied; and a phase control unit that moves a position of the spool by controlling the power supply amount to the control valve to supply the working fluid to the advance chamber and the retard chamber to displace the relative rotation phase. When the spool is in the first position, the intermediate lock mechanism is set to the lock state and a state in which the working fluid is discharged from any one of the advance chamber or the retard chamber and the working fluid is supplied to the other one of the advance chamber or the retard chamber. When the spool is in the second position, the intermediate locking mechanism is set to the lock release state. At a time of starting the internal combustion engine, when the intermediate lock mechanism is in the lock release state and the relative rotation phase is a phase that is displaced in a direction toward the intermediate lock phase when the power supply amount to the control valve is maximized, the phase control unit controls the power supply amount to the control valve so that the relative rotation phase is displaced in the direction toward the intermediate lock phase.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of a valve opening and closing timing control device disclosed here will be described below with reference to the drawings. However, this disclosure is not limited to the following embodiments, and various modifications can be made without departing from the scope of this disclosure.

First Embodiment

[Basic Configuration]

Figure 1:
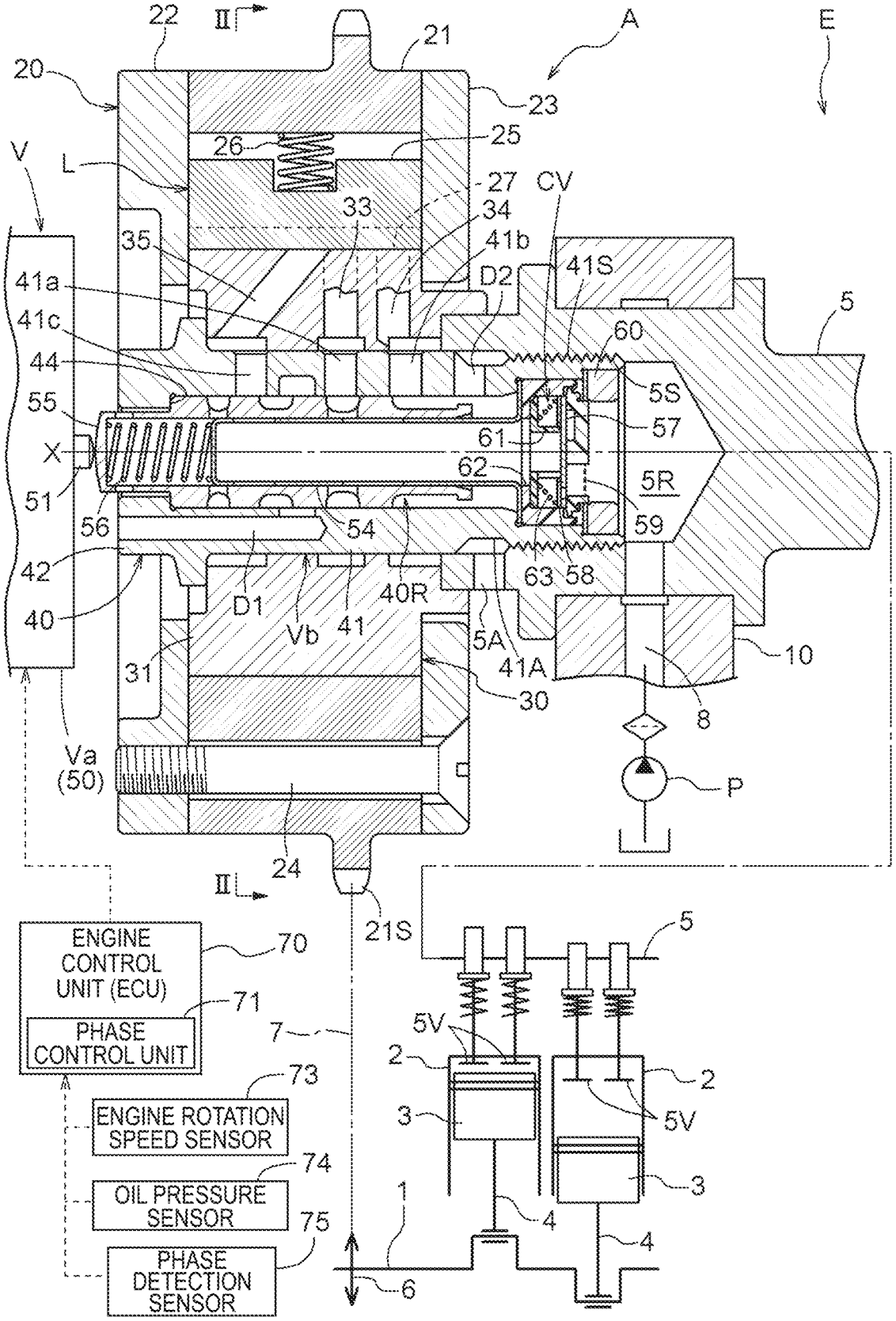
FIG. 1 is a cross-sectional view showing a valve opening and closing timing control device according to a first embodiment.
Figures 2, 3:
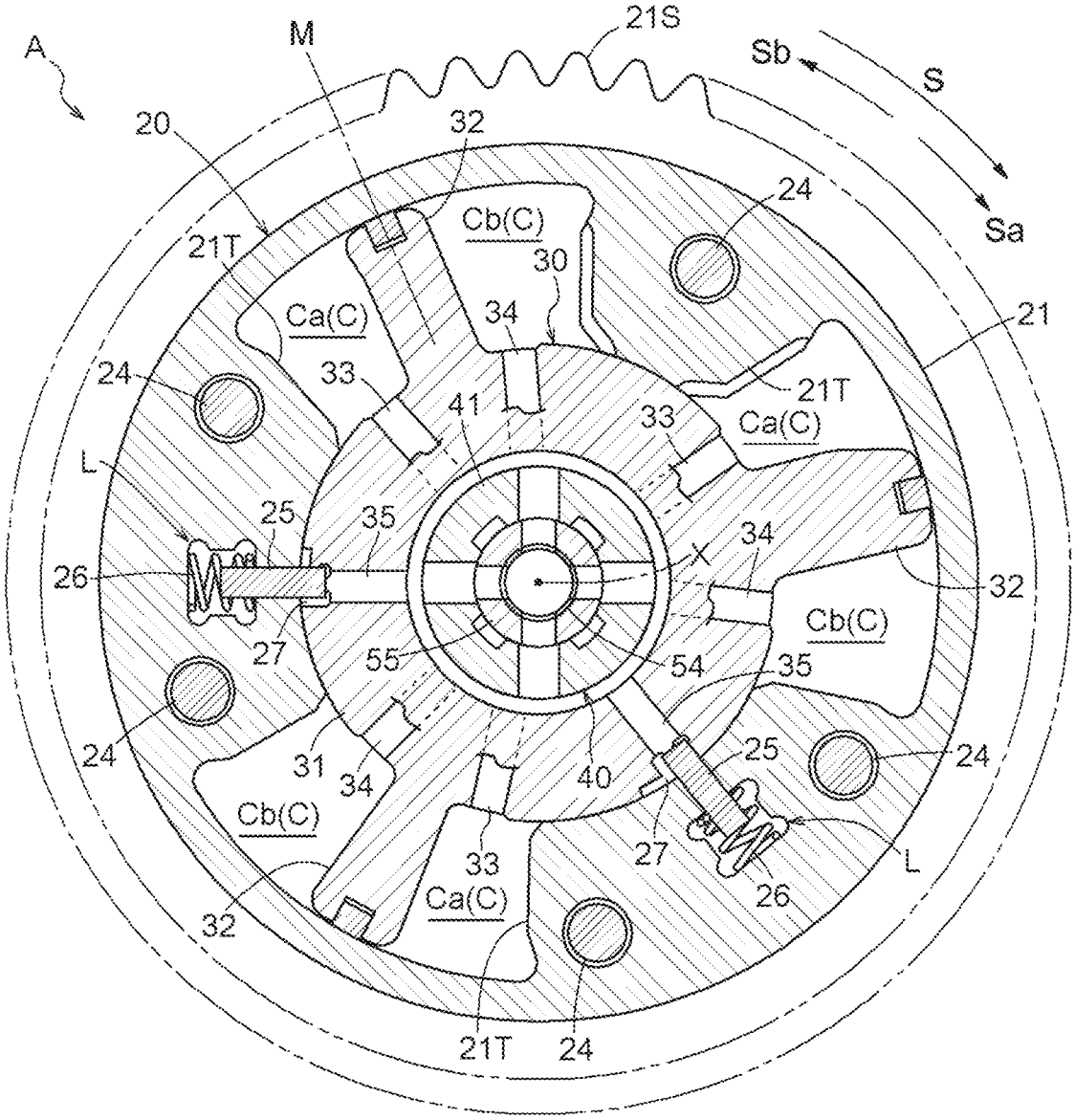
FIG. 2 is a cross-sectional view taken along a line II-II of FIG. 1.
FIG. 3 is a diagram listing a relationship between a position of a spool and supply and discharge of working oil according to the first embodiment.

As shown in FIGS. 1 and 2, a valve opening and closing timing control device A includes an external rotor 20 as a drive-side rotary body, an internal rotor 30 as a driven-side rotary body, and an electromagnetic control valve V that controls supply and discharge of working oil as a working fluid. Since the valve opening and closing timing control device A sets an opening and closing timing (opening and closing period) of an intake camshaft 5 (an example of a valve opening and closing camshaft) of an engine E (an example of an internal combustion engine) of a vehicle such as a passenger car, the valve opening and closing timing control device A is provided coaxially with a rotation axis X of the intake camshaft 5.

The valve opening and closing timing control device A is installed in an automobile engine as an internal combustion engine. An engine control unit (hereinafter referred to as ECU) 70 controls an opening and closing timing of an intake valve (not shown) of the engine E. The ECU 70 includes a phase control unit 71 that controls a relative rotation phase between the external rotor 20 and the internal rotor 30 (hereinafter, simply referred to as "relative rotation phase"). The valve opening and closing timing control device A includes an engine rotation speed sensor 73 that detects an engine rotation speed (an example of rotation speed) of the engine E, an oil pressure sensor 74 that detects oil pressure of a supply flow path 8, and a phase detection sensor 75 that detects the relative rotation phase.

The internal rotor 30 (an example of the driven-side rotary body) is arranged coaxially with the rotation axis X of the intake camshaft 5 (external rotor 20), and is integrally rotated with the intake camshaft 5 by being coupled to the intake camshaft 5 by a coupling bolt 40 (an example of a valve case). The internal rotor 30 is provided inside the external rotor 20. The external rotor 20 (an example of the drive-side rotary body) is arranged coaxially with the rotation axis X and rotates synchronously with a crankshaft 1 of the engine E. With this configuration, the external rotor 20 and the internal rotor 30 are relatively rotatable.

The valve opening and closing timing control device A includes a lock mechanism L (an example of an intermediate lock mechanism) that holds the relative rotation phase at an intermediate lock phase M (an example of an intermediate phase) shown in FIG. 2. The intermediate lock phase M is a phase between a most retarded phase and a most advanced phase. The valve opening and closing timing control device A is controlled to shift to the intermediate lock phase M at the time of stop control of the engine E as an opening and closing timing suitable for starting the engine E. The shift control to the intermediate lock phase M may be executed when the engine E is started.

The electromagnetic control valve V (an example of a control valve) includes an electromagnetic unit Va and a valve unit Vb supported by the engine E.

The electromagnetic unit Va includes a solenoid portion 50 and a plunger 51 that is arranged coaxially with the rotation axis X and protrudes and retracts by drive control of the solenoid portion 50. In the valve unit Vb, a spool 55 that controls the supply and discharge of the working oil (an example of the working fluid) is arranged coaxially with the rotation axis X, and has a position relationship set such that a protrusion end of the plunger 51 abuts against an outer end of the spool 55.

The electromagnetic control valve V sets a protrusion amount of the plunger 51 by controlling electric power supplied to the solenoid portion 50, and operates the spool 55. By this operation, the electromagnetic control valve V controls a flow of the working oil to set an opening and closing timing of an intake valve 5V, and performs switching between a lock state in which the lock mechanism L is restrained to the intermediate lock phase M and a lock release state in which the restraint of the intermediate lock phase M is released. A configuration and a control mode of the electromagnetic control valve V will be described later.

As shown in FIG. 1, the engine E is a four-cycle type engine in which a piston 3 is housed in a cylinder bore of a cylinder block 2 at an upper position, and the piston 3 and the crankshaft 1 are coupled by a coupling rod 4. An upper portion of the engine E includes the intake camshaft 5 for opening and closing the intake valve 5V and an exhaust camshaft (not shown).

A support member 10 that rotatably supports the intake camshaft 5 is formed with a supply flow path 8 through which the working oil is supplied from a hydraulic pump P driven by the engine E. The hydraulic pump P supplies lubricating oil stored in an oil pan of the engine E to the valve unit Vb as the working oil through the supply flow path 8.

A timing chain 7 is wound around an output sprocket 6 formed on the crankshaft 1 of the engine E and a timing sprocket 21S of the external rotor 20. Accordingly, the external rotor 20 rotates synchronously with the crankshaft 1. A sprocket is also provided at a front end of the exhaust camshaft on an exhaust side, and the timing chain 7 is also wound around the sprocket.

As shown in FIG. 2, the external rotor 20 rotates in a drive rotation direction S by a driving force from the crankshaft 1. A direction in which the internal rotor 30 rotates relative to the external rotor 20 in the same direction as the drive rotation direction S is referred to as an advance direction Sa, and a reverse direction to the direction is referred to as a retard direction Sb. In the valve opening and closing timing control device A, a relationship between the crankshaft 1 and the intake camshaft 5 is set such that an intake compression ratio is increased as a displacement amount when the relative rotation phase is displaced in the advance direction Sa increases, and the intake compression ratio is reduced as a displacement amount when the relative rotation phase is displaced in the retard direction Sb increases.

The present embodiment describes the valve opening and closing timing control device A provided on the intake camshaft 5. The valve opening and closing timing control device A may be provided on the exhaust camshaft, and may be provided on both the intake camshaft 5 and the exhaust camshaft.

As shown in FIG. 1, the external rotor 20 includes an external rotor body 21, a front plate 22, and a rear plate 23, which are integrated by fastening a plurality of fastening bolts 24. The timing sprocket 21S is formed on an outer periphery of the external rotor body 21.

As shown in FIG. 2, a plurality of (three in the present embodiment) protrusion portions 21T protruding inward in a radial direction are integrally formed on the external rotor body 21. The internal rotor 30 includes a columnar internal rotor body 31 that is in close contact with the protrusion portions 21T of the external rotor body 21, and a plurality of (three in the present embodiment) vane portions 32 (an example of a partition portion) protruding outward in the radial direction from an outer periphery of the internal rotor body 31 so as to come into contact with an inner peripheral surface of the external rotor body 21.

As described above, the internal rotor 30 is provided inside the external rotor 20, and a plurality of (three in the present embodiment) fluid pressure chambers C are formed on an outer peripheral side of the internal rotor body 31 at positions between a pair of protrusion portions 21T adjacent to each other in the rotation direction. The fluid pressure chambers C are partitioned by the vane portions 32, and thus advance chambers Ca and retard chambers Cb are defined. Further, the internal rotor body 31 is formed with advance flow paths 33 communicating with the advance chambers Ca and retard flow paths 34 communicating with the retard chambers Cb.

As shown in FIGS. 1 and 2, the lock mechanism L includes a lock member 25 that is supported to be freely protruded and retracted in the radial direction with respect to each of the two protrusion portions 21T of the external rotor 20, a lock spring 26 that protrudes and biases the lock member 25, and a lock recess 27 formed on the outer periphery of the internal rotor body 31. A lock control flow path 35 communicating with the lock recess 27 is formed in the internal rotor body 31.

The lock mechanism L functions to regulate the relative rotation phase to the intermediate lock phase M by simultaneously engaging the two lock members 25 with the corresponding lock recesses 27 by a biasing force of the lock spring 26 (lock state). By supplying the working oil to the lock control flow path 35 in this lock state, the lock member 25 is disengaged from the lock recess 27 against the biasing force of the lock spring 26 to release the lock state (lock release state). Conversely, by discharging the working oil from the lock control flow path 35, the lock member 25 that receives the biasing force of the lock spring 26 is engaged with the lock recess 27 to allow the lock member 25 to shift to the lock state.

The lock mechanism L may be configured by engaging the single lock member 25 with the corresponding single lock recess 27. Further, the lock mechanism L may have a configuration in which the lock member 25 is guided so as to move in the rotation axis X direction.

[Coupling Bolt]

Figure 4:
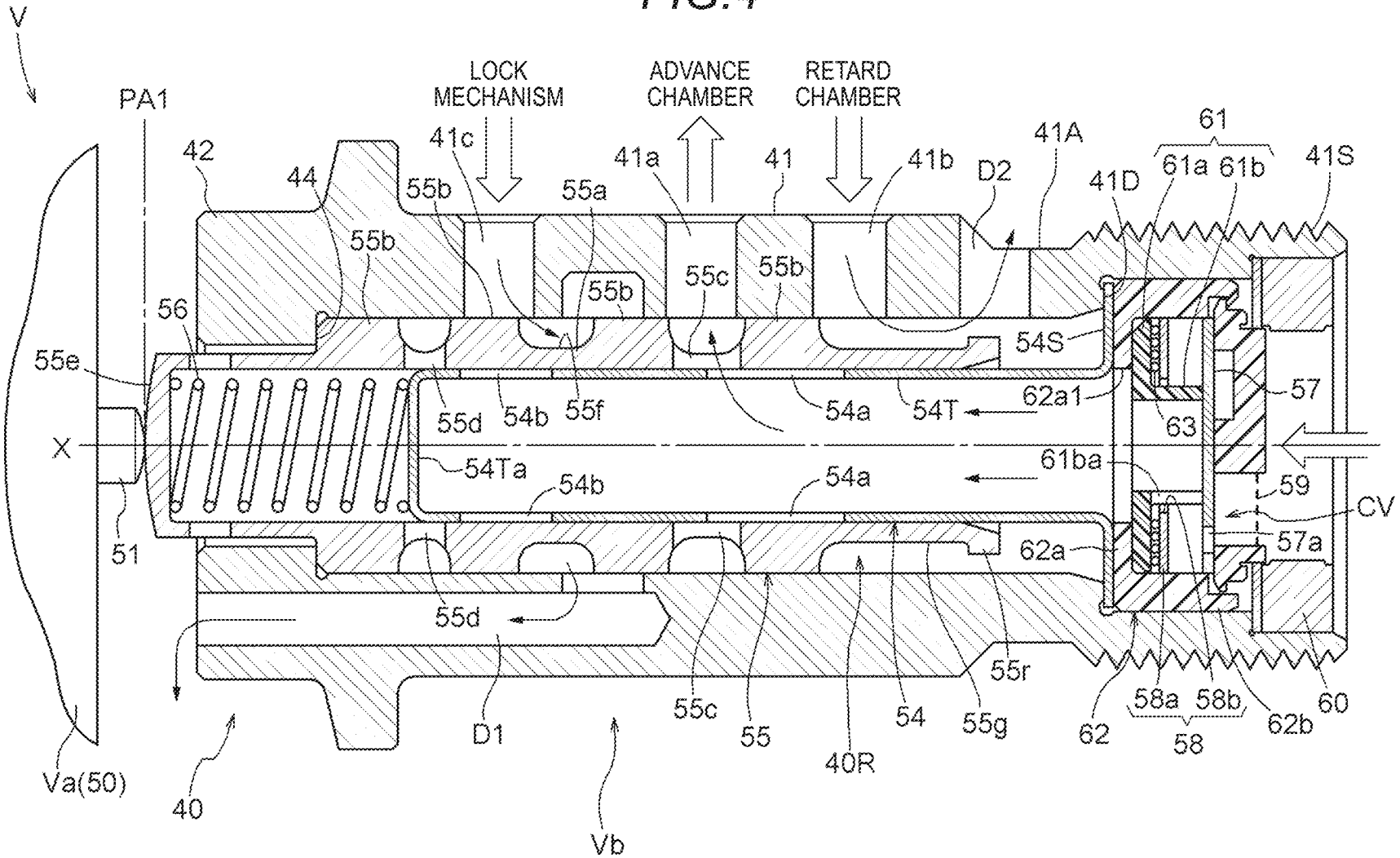
FIG. 4 is a cross-sectional view of a valve unit in which the spool is in a first advance position according to the first embodiment.

As shown in FIGS. 1 and 4, the coupling bolt 40 (an example of the valve case) is integrally formed with a bolt body 41 which is generally tubular and a bolt head 42 on an outer end side (left side in FIG. 4). An internal space 40R that runs in the rotation axis X direction is formed inside the coupling bolt 40, and a male screw portion 41S is formed on an outer periphery of an inner end side (right side in FIG. 4) of the bolt body 41. An annular constriction portion 41A, which is an annular groove along the outer periphery of the bolt body 41, is formed on an outer end side of the bolt body 41 adjacent to the male screw portion 41S.

As shown in FIG. 1, the intake camshaft 5 defines a shaft internal space 5R centered on the rotation axis X, and a female screw portion 5S is formed on an inner periphery of the shaft internal space 5R. The shaft internal space 5R communicates with the supply flow path 8 and is supplied with the working oil from the hydraulic pump P.

With this configuration, the bolt body 41 is inserted into the internal rotor 30, the male screw portion 41S is screwed to the female screw portion 5S of the intake camshaft 5, and the internal rotor 30 is fastened to the intake camshaft 5 by the rotation operation of the bolt head 42. By the fastening, the internal rotor 30 is fixed to the intake camshaft 5, and the shaft internal space 5R and the internal space 40R of the coupling bolt 40 (strictly, an internal space of a fluid supply pipe 54) communicate with each other.

As shown in FIG. 4, a regulation wall 44 is formed on the outer end side of the inner peripheral surface of the internal space 40R of the coupling bolt 40 in the rotation axis X direction. The regulation wall 44 protrudes in a direction of approaching the rotation axis X. The regulation wall 44 regulates a protrusion position by abutting a land portion 55*b* on an outer end side of the spool 55, which will be described later. In a region from an intermediate position of the coupling bolt 40 to an end portion on the outer end side thereof, a plurality of (four in the present embodiment) first drain flow paths D1 are formed in an elongated hole shape with one end blocked along the rotation axis X.

In the bolt body 41, a plurality of lock ports 41*c* (four in the present embodiment) communicating with the lock control flow path 35, a plurality of (four in the present embodiment) advance ports 41*a* communicating with the advance flow path 33, and a plurality of (four in the present embodiment) retard ports 41*b* communicating with the retard flow path 34 are formed as through holes connecting the internal space 40R and the outer peripheral surface in order from the outer end side to the inner end side of the coupling bolt 40 (see also FIG. 1). On an inner end side of the retard port 41*b* of the bolt body 41, a plurality of (four in the present embodiment) second drain flow paths D2 are formed as through holes connecting the internal space 40R and the outer peripheral surface, and communicate with the annular constriction portion 41A. The annular constriction portion 41A communicates with a drain communication path 5A formed through the end portion of the intake camshaft 5, and the working oil from the second drain flow path D2 is discharged to the outside through the drain communication path 5A (see also FIG. 1). That is, in the present embodiment, due to the configuration in which the first drain flow path D1 extends in the rotation axis X direction and the second drain flow path D2 extends in the radial direction orthogonal to the rotation axis X direction, the first drain flow path D1 and the second drain flow path D2 extend in directions intersecting each other at different positions in the rotation axis X direction. The drain communication path 5A may be formed at an end portion of the internal rotor 30, or may be formed at a boundary position between the internal rotor 30 and the intake camshaft 5.

[Valve Unit]

As shown in FIGS. 1 and 4, the valve unit Vb includes the fluid supply pipe 54 that is coaxial with the rotation axis X and is housed in the internal space 40R, and the spool 55 that is freely slidable in the rotation axis X direction while being guided by the inner peripheral surface of the coupling bolt 40 and an outer peripheral surface of a pipeline portion 54T of the fluid supply pipe 54. The valve unit Vb includes a spool spring 56 as a biasing member that biases the spool 55 in the protrusion direction, a check valve CV, an oil filter 59, and a fixing ring 60.

The fluid supply pipe 54 includes the pipeline portion 54T inserted in the spool 55 and a flange-shaped base end portion 54S at which the inner end side of the pipeline portion 54T is bent in an annular shape. The pipeline portion 54T and the base end portion 54S are integrally formed. The base end portion 54S abuts on a regulation step portion 41D provided at a boundary position on the inner peripheral side between the male screw portion 41S and the annular constriction portion 41A of the coupling bolt 40. In the pipeline portion 54T, a plurality of (three in the present embodiment) first supply ports 54*a* are formed near the base end portion 54S, and a plurality of (three in the present embodiment) second supply ports 54*b* are formed on the outer end side of the first supply ports 54*a*.

The three first supply ports 54*a* are wide in the circumferential direction and have an elongated hole shape extending in the rotation axis X direction. Four intermediate hole portions 55*c* formed in the spool 55 at positions corresponding to the first supply ports 54*a* are circular. From such a configuration, the working oil from the pipeline portion 54T can be reliably supplied to the intermediate hole portions 55*c*.

Similar to the first supply ports 54*a*, the second supply ports 54*b* also have an elongated hole shape extending in the rotation axis X direction. Four end hole portions 55*d* formed in the spool 55 at positions corresponding to the second supply ports 54*b* are circular. From such a configuration, the working oil can be reliably supplied from the pipeline portion 54T to the end hole portions 55*d*.

The spool 55 is formed with a spool body 55*a* which is tubular and has an abutting surface formed on the outer end side, and four land portions 55*b* formed on the outer periphery thereof in a protruding state. An internal flow path is formed inside the spool 55. A plurality of (four in the present embodiment) intermediate hole portions 55*c* communicating with the internal flow path are formed at an intermediate position of the pair of land portions 55*b* on an inner end side in the rotation axis X direction. A plurality of (four in the present embodiment) end hole portions 55*d* communicating with the internal flow path are formed at the intermediate position of the pair of land portions 55*b* on an outer end side in the rotation axis X direction. An intermediate annular groove 55*f* that does not communicate with the internal flow path is formed at the intermediate position of the pair of land portions 55*b* between the intermediate hole portion 55*c* and the end hole portion 55*d*. An elongated groove-shaped end annular groove 55*g* that does not communicate with the internal flow path is formed on an inner end side of the land portion 55*b* on an innermost end side in the rotation axis X direction.

The spool 55 is formed with an abutting end portion 55*r* that abuts on the base end portion 54S of the fluid supply pipe 54 to determine an operation limit when the spool 55 is operated in a pushing direction. The abutting end portion 55*r* is provided at an end portion of a region where the spool body 55*a* is extended. Even when the spool 55 is pushed in with an excessive force, a defect that the spool 55 operates beyond the operation limit is prevented.

The spool spring 56 is a compression coil type spring, and is arranged between a bottom wall 55*e* on an outer end side of the spool 55 and a bottom wall 54Ta on an outer end side of the pipeline portion 54T of the fluid supply pipe 54. When the electric power is not supplied to the solenoid portion 50 of the electromagnetic unit Va due to an action of the biasing force (power supply amount is zero), the land portion 55*b* on the outer end side abuts on the regulation wall 44 and the spool 55 is maintained at a first advance position PA1 shown in FIG. 4.

[Check Valve]

The check valve CV includes an opening plate 57 and a valve plate 58 which are formed of metal plates having an equal outer diameter, a guide member 61, a tubular member 62, and a valve spring 63. An annular opening portion 57*a* centered on the rotation axis X is formed at an outer peripheral position of the opening plate 57. A circular valve body 58*a* having a diameter larger than that of the opening portion 57*a* is arranged at the outer peripheral position of the valve plate 58, and a circular opening portion 58*b* centered on the rotation axis X is formed at a center position.

The guide member 61 includes a bottom portion 61*a* and a tubular protrusion portion 61*b* protruding from the bottom portion 61*a*. A plurality of slits 61*ba* are formed on a side wall of the protrusion portion 61*b*. The protrusion portion 61*b* is inserted into the opening portion 58*b* of the valve plate 58, and the valve plate 58 is guided by the protrusion portion 61*b* and moves. The tubular member 62 includes a bottom portion 62*a* and an annular portion 62*b* that protrudes annularly from an outer periphery of the bottom portion 62*a*. An opening portion 62*a*1 having substantially the same diameter as the inner diameter of the pipeline portion 54T of the fluid supply pipe 54 is formed at the center of the bottom portion 62*a*. The opening plate 57, the valve plate 58, the guide member 61, and the valve spring 63 are housed inside the annular portion 62*b*, and the oil filter 59 abuts on the end portion of the annular portion 62*b*.

The valve spring 63 is a compression coil type spring and is arranged between the bottom portion 61*a* of the guide member 61 and the valve body 58*a* of the valve plate 58. The check valve CV is configured such that, when pressure downstream increases or when discharge pressure of the hydraulic pump P decreases, the valve body 58*a* comes into close contact with the opening plate 57 by the biasing force of the valve spring 63 to close the opening portion 57*a*.

The oil filter 59 has a structure in which a metal net body is reinforced with a resin frame, and removes dust contained in the working oil. The fixing ring 60 is press-fitted and fixed to an inner periphery of the end portion of the coupling bolt 40, and positions of the oil filter 59, the opening plate 57, and the valve plate 58 are determined by the fixing ring 60. The tubular member 62, the guide member 61, the valve spring 63, the opening plate 57, and the valve plate 58 constituting the check valve CV are arranged in this order, the oil filter 59 is arranged in the internal space 40R so as to be further overlapped, and the fixing ring 60 is press-fitted and fixed to the inner periphery of the internal space 40R.

In this way, by fixing with the fixing ring 60, the base end portion 54S of the fluid supply pipe 54 is sandwiched and fixed between the bolt body 41 and the tubular member 62. Due to the biasing force of the spool spring 56 that abuts on the bottom wall 54Ta of the fluid supply pipe 54, the land portion 55*b* on the outer end side of the spool 55 abuts on the regulation wall 44, and a position in the rotation axis X direction is determined.

[Operation Mode]

In the valve opening and closing timing control device A, when the electric power is not supplied to the solenoid portion 50 of the electromagnetic unit Va, no pressing force acts on the spool 55 from the plunger 51, and a position of the spool 55 is maintained in a state where the land portion 55*b* at the outer side position abuts on the regulation wall 44 by the biasing force of the spool spring 56 as shown in FIG. 4.

A movement start position of the spool 55 is the first advance position PA1 (an example of a first position). By increasing the electric power supplied to the solenoid portion 50 of the electromagnetic unit Va, as shown in FIG. 3, the spool 55 can be freely operated to a second advance position PA2 (an example of a second position), a neutral position PN (an example of the second position), and a retard position PB (an example of the second position) in this order. That is, by setting the electric power supplied to the solenoid portion 50 of the electromagnetic unit Va, the spool 55 can be operated to any one of the four operation positions. When the spool 55 is operated to the retard position PB, the spool 55 is at the movement end position that maximizes the electric power supplied to the solenoid portion 50.

Further, in the valve unit Vb, the first advance position PA1 is set to a lock position. In this lock position, the lock mechanism L can shift to the lock state. When the spool 55 is operated to one of the first advance position PA1 (see FIG. 4) and the second advance position PA2 (see FIG. 5), the working oil supplied from the hydraulic pump P is sent to the advance port 41*a* through the intermediate hole portion 55*c* of the spool 55, and is further supplied to the advance chamber Ca from the advance flow path 33. At the same time, the working oil in the retard chamber Cb flows from the retard flow path 34 to the retard port 41*b*, and is discharged from the second drain flow path D2 through the end annular groove 55*g* of the spool 55 to the outside through the annular constriction portion 41A and the drain communication path 5A.

In the first advance position PA1, as shown in FIG. 4, in cooperation with the supply of the working oil to the advance chamber Ca and the discharge of the working oil from the retard chamber Cb, the working oil in the lock recess 27 flows from the lock control flow path 35 to the lock port 41*c*, and is discharged from the first drain flow path D1 through the intermediate annular groove 55*f* of the spool 55. As a result, when the vane portion 32 of the internal rotor 30 moves in the advance direction Sa and reaches the intermediate lock phase M, the lock member 25 engages with the lock recess 27 by the biasing force of the lock spring 26 to be in the lock state.

Figure 5:
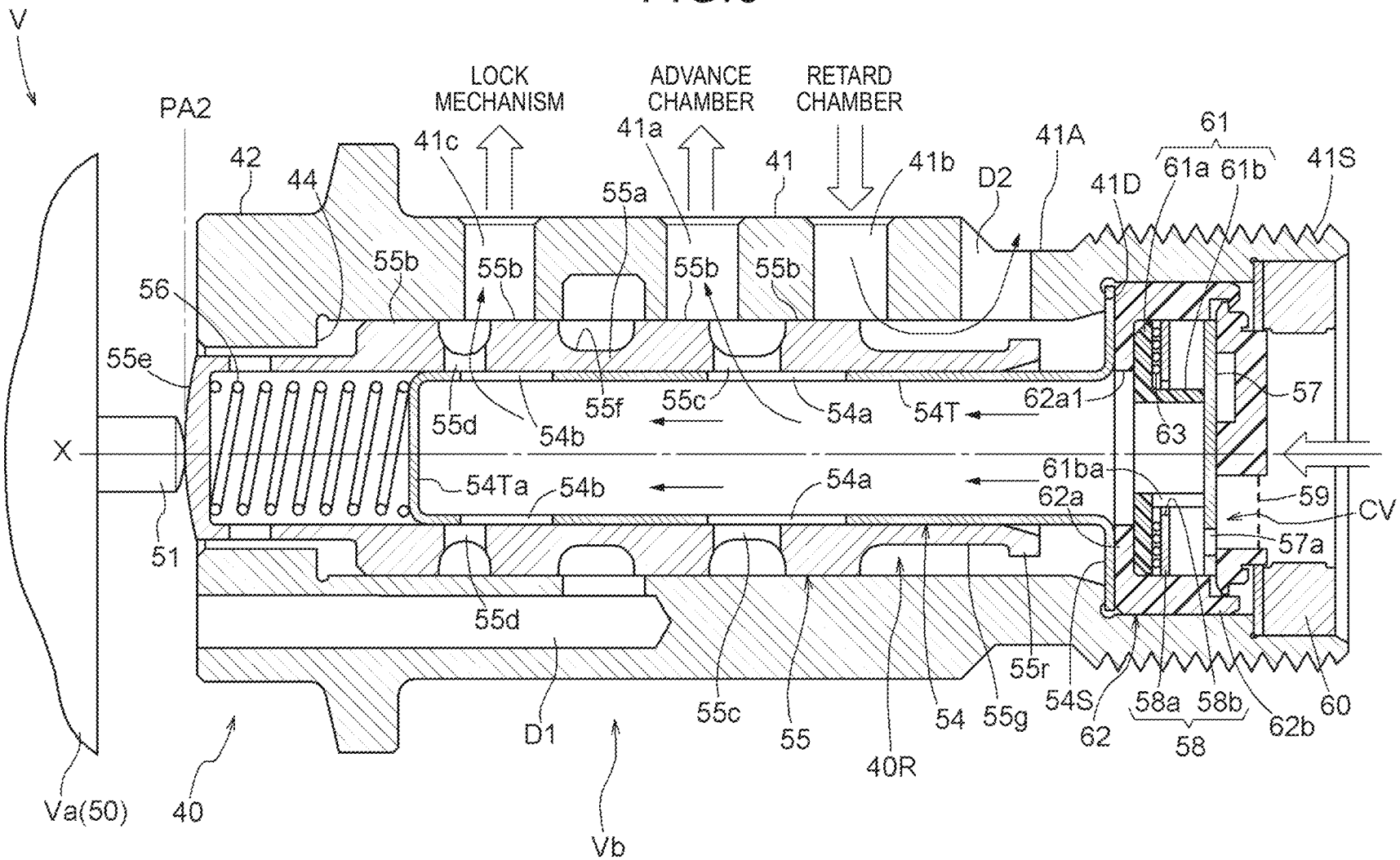
FIG. 5 is a cross-sectional view of the valve unit in which the spool is in a second advance position according to the first embodiment.

In the second advance position PA2, as shown in FIG. 5, in cooperation with the supply of the working oil to the advance chamber Ca, the working oil flows from the lock port 41*c* to the lock recess 27 through the lock control flow path 35, and the pressure of the working oil is applied to the lock member 25. As a result, the operation in the advance direction Sa is continuously performed in a state where the lock of the lock mechanism L is released.

Figure 6:
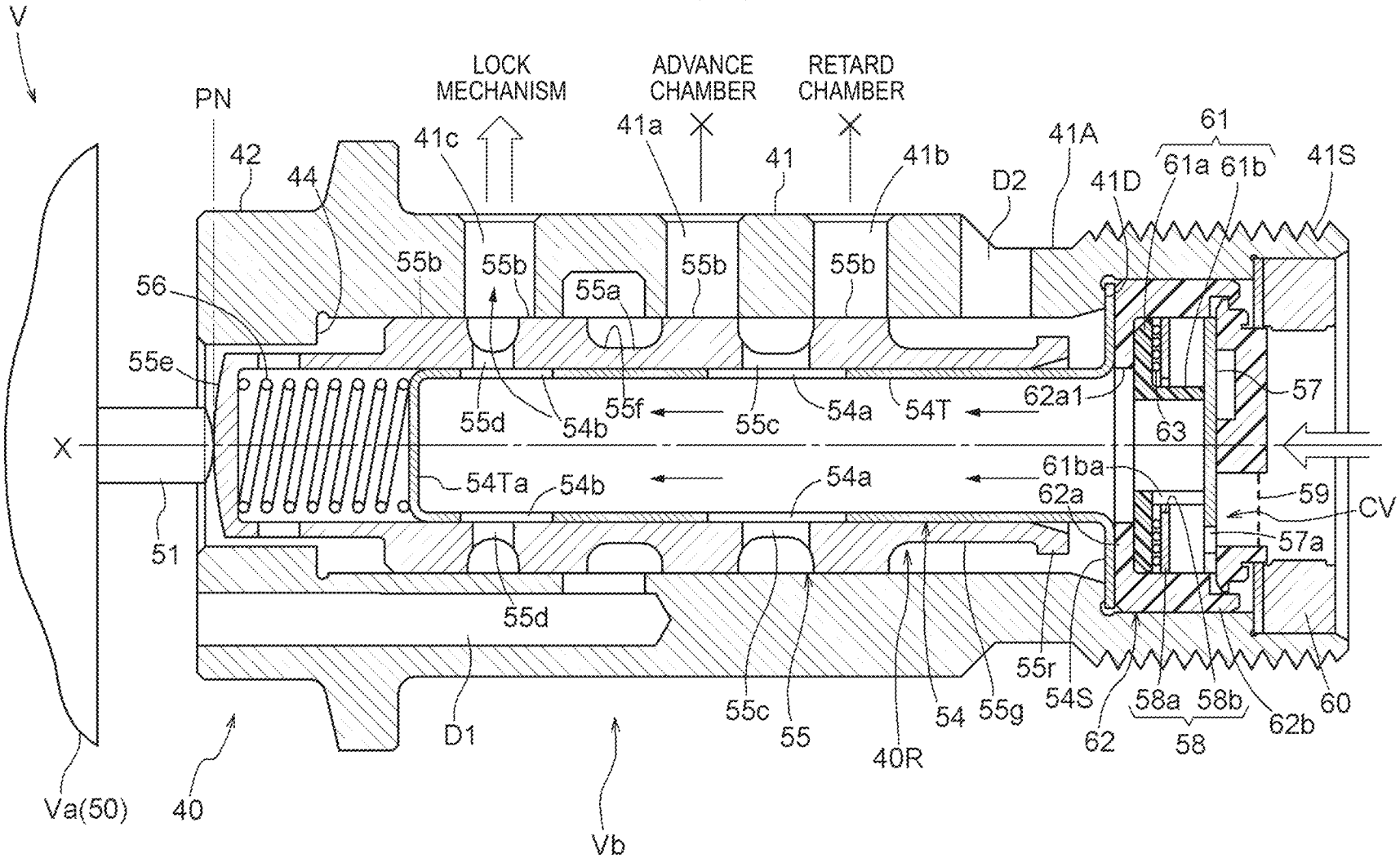
FIG. 6 is a cross-sectional view of the valve unit in which the spool is in a neutral position according to the first embodiment.

When the spool 55 is operated to the neutral position PN, as shown in FIG. 6, the pair of land portions 55*b* are in such a position relationship that the advance port 41*a* and the retard port 41*b* are closed, and the supply and discharge of the working oil to the advance chamber Ca and the retard chamber Cb are cut off, and the relative rotation phase is maintained. In the neutral position PN, the working oil flows from the lock port 41*c* to the lock recess 27 through the lock control flow path 35, the pressure of the working oil is applied to the lock member 25, and the state where the lock of the lock mechanism L is released continues.

Figure 7:
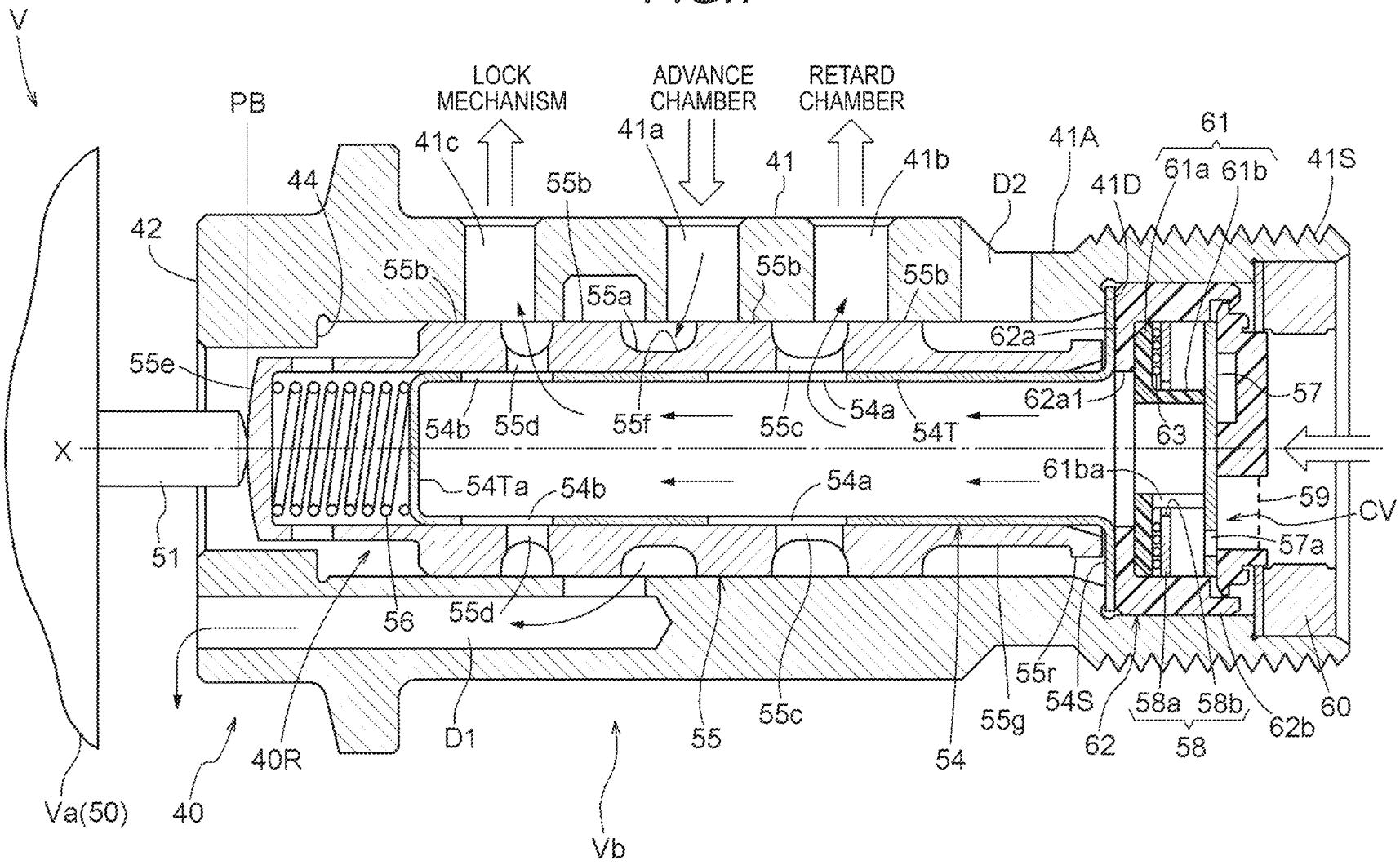
FIG. 7 is a cross-sectional view of the valve unit in which the spool is in a retard position according to the first embodiment.

When the spool 55 is operated to the retard position PB, as shown in FIG. 7, the working oil supplied from the hydraulic pump P is sent to the retard port 41*b* through the intermediate hole portion 55*c* of the spool 55, and is further supplied to the retard chamber Cb from the retard flow path 34. At the same time, the working oil in the advance chamber Ca flows from the advance flow path 33 to the advance port 41*a*, and is discharged from the first drain flow path D1 through the intermediate annular groove 55*f* of the spool 55.

In this way, in any of the four operation positions, the working oil of the lock mechanism L and the working oil of the advance chamber Ca or the retard chamber Cb are not discharged to the first drain flow path D1 at the same time, and the same applies to the second drain flow path D2. Therefore, it is possible to smoothly discharge the working oil from the lock mechanism L and to reliably shift to the lock state. In addition, it is possible to smoothly discharge the working oil from the advance chamber Ca or the retard chamber Cb to improve the responsiveness of the phase control.

In the present embodiment, the first drain flow path D1 through which the working oil is discharged from the advance chamber Ca through the spool 55 and the second drain flow path D2 through which the working oil is discharged from the retard chamber Cb through the spool 55 extend in directions intersecting each other at different positions in the rotation axis X direction of the coupling bolt 40. As a result, it is possible to sufficiently ensure locations for providing the drain flow paths D1 and D2 on the coupling bolt 40, and it is possible to increase a flow path cross-sectional area of the first drain flow path D1 and the second drain flow path D2. Therefore, the flow path cross-sectional area of the drain flow paths D1 and D2 through which the working oil is discharged from the advance chamber Ca or the retard chamber Cb can be increased to improve the responsiveness of the phase control. In addition, since the discharge of the working oil from the lock mechanism L is also used in the first drain flow path D1, it is not necessary to separately provide a lock drain flow path extending in the rotation axis X direction of the coupling bolt 40, so that a sufficient flow path cross-sectional area of the first drain flow path D1 can be ensured.

[Control Configuration]

As shown in FIG. 1, signals from the engine rotation speed sensor 73, the oil pressure sensor 74, and the phase detection sensor 75 are input to the ECU 70. The phase control unit 71 of the ECU 70 controls the timing of the intake valve by the valve opening and closing timing control device A during operation of the engine E, shifts the relative rotation phase to the intermediate lock phase M when the engine E is stopped, and sets the lock mechanism L to the lock state.

A control operation of the relative rotation phase by the phase control unit 71 at the time of engine stall of the engine E will be described based on a time chart shown in FIG. 8. In the time chart of FIG. 8, it is assumed that the engine E is stopped due to the engine stall during operation at an engine rotation speed N of, for example, about 1000 rpm.

Figure 8:
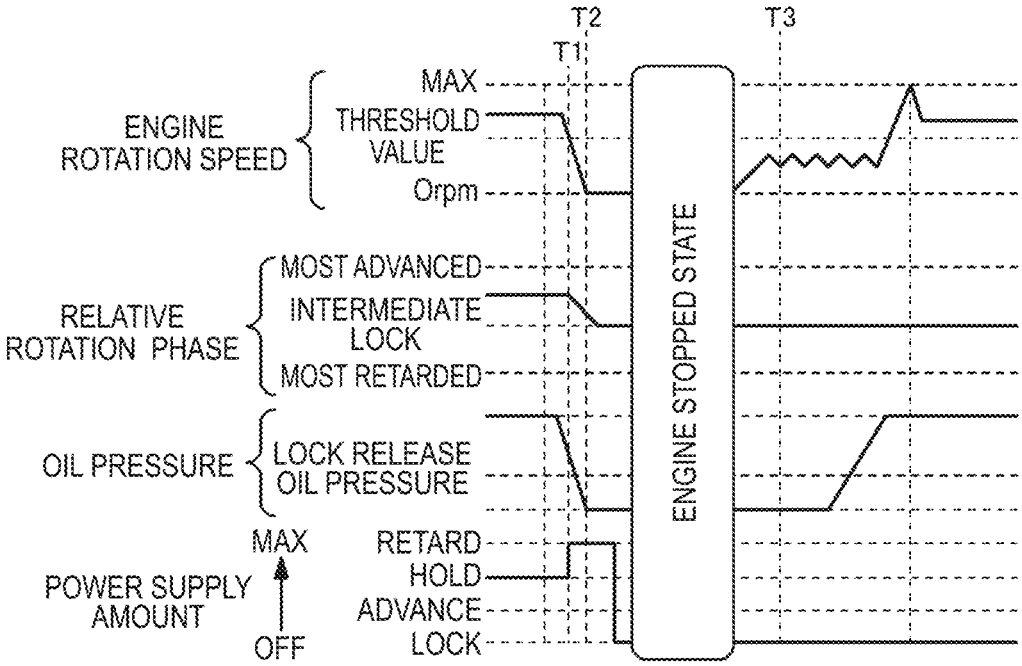
FIG. 8 is a time chart showing a control operation of a relative rotation phase according to the first embodiment.

In the example shown in FIG. 8, during the operation of the engine E, the electromagnetic control valve V is held in the neutral position PN and is in the lock release state. The relative rotation phase is held on an advance side with respect to the intermediate lock phase M.

In FIG. 8, T1 is a timing when the engine rotation speed of the engine E becomes less than a threshold value (an example of a predetermined value) during vehicle operation due to some reason. The threshold value is, for example, the engine rotation speed of the engine E during an idling operation. When the phase control unit 71 detects that the engine rotation speed becomes less than the threshold value based on an output from the engine rotation speed sensor 73, the phase control unit 71 controls a power supply amount to the electromagnetic control valve V so that the relative rotation phase is displaced in a direction toward the intermediate lock phase M. Specifically, the power supply amount to the electromagnetic control valve V is increased (for example, maximized). The spool 55 is moved to the retard position PB. Accordingly, the relative rotation phase is operated toward the retard direction Sb and thus is toward the intermediate lock phase M. At this time, since a rotation speed of the hydraulic pump P that supplies the working fluid to the lock mechanism L (lock recess 27) also decreases with the engine stall, pressure of the working oil flowing through the supply flow path 8 is lower than pressure required to release the lock (hereinafter, referred to as "lock release oil pressure") between the timing T1 and a timing T2. Thereafter, at the timing T2, the engine rotation speed of the engine E and the rotation speed of the hydraulic pumps P become zero, and the engine E is stopped. At the same time as or after the timing T2, the relative rotation phase is displaced to the intermediate lock phase M to be in the lock state. In the control shown in FIG. 8, when the power supply to the electromagnetic control valve V is continued even after the engine E is stopped and the phase detection sensor 75 detects that the relative rotation phase is not displaced from the intermediate lock phase M, the phase control unit 71 determines that the relative rotation phase is locked at the intermediate lock phase M, and sets the power supply amount to the electromagnetic control valve V to zero.

When the engine stall occurs in a vehicle equipped with the valve opening and closing timing control device A, the engine is stopped in a fairly short time without an engine stop command. Therefore, in general, the relative rotation phase cannot be displaced to the intermediate lock phase M to be in the lock state until the engine E is stopped.

In contrast, in the present embodiment as described above, when the lock mechanism L is in the lock release state and the relative rotation phase is a phase that is displaced in the direction toward the intermediate lock phase M when the power supply amount to the electromagnetic control valve V is maximized, if the engine rotation speed of the engine E becomes less than the threshold value, the phase control unit 71 controls the power supply amount to the electromagnetic control valve V so that the relative rotation phase is displaced in the direction toward the intermediate lock phase M. That is, when the engine rotation speed of the engine E becomes less than the threshold value, the phase control unit 71 detects that the engine E is in a state toward the engine stall, and controls the power supply amount to the electromagnetic control valve V. Specifically, the phase control unit 71 increases the power supply amount to the electromagnetic control valve V to control the relative rotation phase in the direction toward the intermediate lock phase M (retard direction Sb). In this way, when the engine stall occurs, by increasing (for example, maximizing) the power supply amount to the electromagnetic control valve V, the relative rotation phase, which is the phase displaced in the direction toward the intermediate lock phase M, can be displaced to the intermediate lock phase M. At this time, with the engine stall of the engine E, the rotation speed of the hydraulic pump P also decreases, and the oil pressure of the working oil flowing through the supply flow path 8 is lower than minimum oil pressure for maintaining the lock release state (hereinafter, referred to as "lock release oil pressure"). Therefore, the relative rotation phase is displaced to the intermediate lock phase M at the timing T2 after a predetermined time from the timing T1 or thereafter, and is in the lock state. As a result, since the engine E is stopped in a state in which the lock mechanism L is shifted to the lock state, the startability at the time of restarting the engine E can be improved.

In FIG. 8, T3 is a timing when the engine E is restarted and is in a cranking state after the engine E is left in the stopped state. At the timing T3, the relative rotation phase detected by the phase detection sensor 75 is input to the phase control unit 71. In the example of FIG. 8, when the engine stall occurs in the engine E, the relative rotation phase is displaced to the intermediate lock phase M to be in the lock state. Therefore, at the timing T3, the phase control unit 71 maintains the power supply amount to the electromagnetic control valve V at zero and maintains the relative rotation phase restrained to the intermediate lock phase M.

The control operation of the relative rotation phase by the phase control unit 71 at the time of restarting the engine E after the engine stall in the first embodiment will be described based on a time chart shown in FIG. 9. In the time chart shown in FIG. 9, when the engine stall occurs in the engine E, the phase control unit 71 performs control to increase (for example, maximize) the power supply amount to the electromagnetic control valve V and move the spool 55 to the retard position PB. However, since the power supply to the electromagnetic control valve V is stopped due to the stop of the engine E, it is assumed that the relative rotation phase cannot be displaced to the intermediate lock phase M.

When the engine E is restarted in this way, the electromagnetic control valve V is held in the lock position of the first advance position PA1, and the relative rotation phase is held on the advance side with respect to the intermediate lock phase M.

Figure 9:
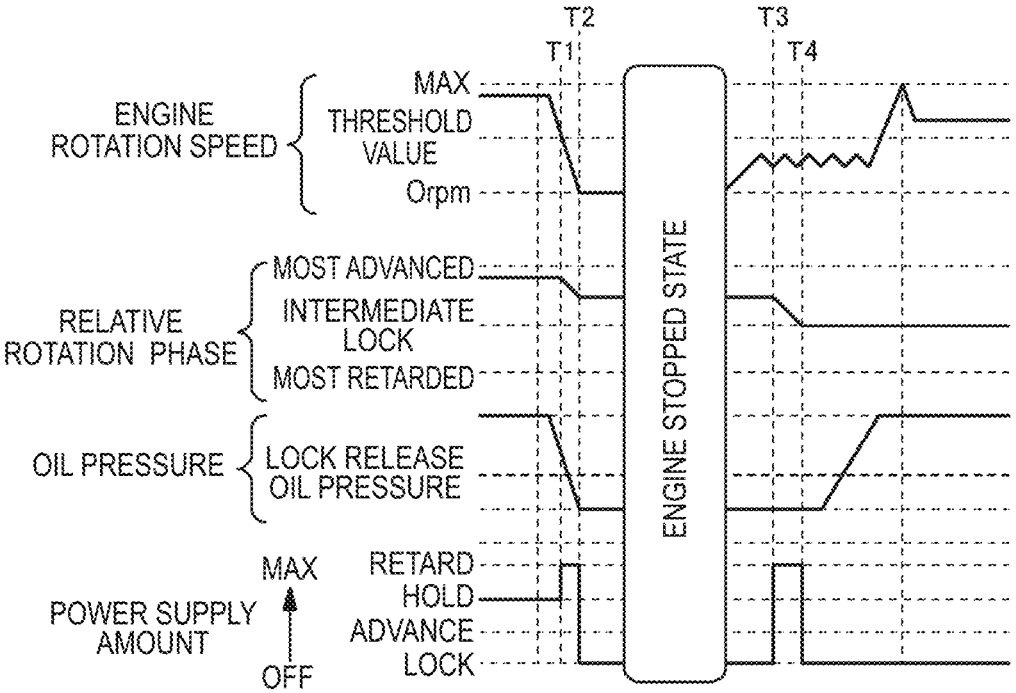
FIG. 9 is a time chart showing the control operation of the relative rotation phase according to the first embodiment.

In FIG. 9, at the timing T3 when the engine E is restarted and in the cranking state, if the phase control unit 71 detects that the relative rotation phase is not at the intermediate lock phase M based on the output from the phase detection sensor 75, the phase control unit 71 controls the power supply amount to the electromagnetic control valve V so that the relative rotation phase is displaced in the direction toward the intermediate lock phase M. Specifically, the power supply amount to the electromagnetic control valve V is increased (for example, maximized), and the spool 55 is moved to the retard position PB. Here, the relative rotation phase is displaced in the retard direction Sb under influence of a cam fluctuation torque of the intake camshaft 5 due to cranking. Further, since the spool 55 is moved to the retard position PB, the working oil is discharged from the advance chamber Ca. Accordingly, the relative rotation phase tends to be displaced in the retard direction Sb and thus is toward the intermediate lock phase M. At this time, since the engine E is restarted immediately, the oil pressure in the supply flow path 8 is lower than the lock release oil pressure. Therefore, the relative rotation phase is displaced to the intermediate lock phase M at a timing T4 after an elapse of a predetermined time from the timing T3, and is in the lock state.

Accordingly, even if the relative rotation phase is not restrained to the intermediate lock phase M when the engine is stopped due to the engine stall or the like of the engine E, when the engine E is restarted, the relative rotation phase can be quickly displaced to the intermediate lock phase M to be in the lock state. As a result, the combustion of the engine E can be started in the state in which the relative rotation phase is locked at the intermediate lock phase M. The startability at the time of restarting the engine E can be ensured.

Modification of First Embodiment

In the example shown in FIG. 8, when the oil pressure in the supply flow path 8 becomes less than the predetermined value (for example, lock release oil pressure) based on the output from the oil pressure sensor 74 in place of the decrease in the engine rotation speed of the engine E or together with the decrease in the engine rotation speed of the engine E, the phase control unit 71 may control the power supply amount to the electromagnetic control valve V so that the relative rotation phase is displaced in the direction toward the intermediate lock phase M.

In the engine E, since the rotation speed of the hydraulic pump P also decreases as the engine rotation speed decreases, the oil pressure of the working fluid flowing through the supply flow path 8 decreases. Therefore, when the phase control unit 71 detects that the oil pressure becomes less than the predetermined value, the occurrence of the subsequent engine stall can be accurately predicted. Accordingly, the phase control unit 71 can control the power supply amount to the electromagnetic control valve V at an appropriate timing to displace the relative rotation phase to the intermediate lock phase M.

In the present embodiment, the check valve CV is provided inside the valve unit Vb of the supply flow path 8 of the working oil. Accordingly, the working oil does not flow back from the valve unit Vb (the supply flow path 8) due to the presence of the check valve CV. Therefore, when the engine stall occurs in the engine E, or when the engine E is started, even if the hydraulic pump P is not rotating and the oil pressure upstream of the check valve CV decreases, a decrease in the oil pressure inside the valve opening and closing timing control device A is prevented, and the working oil can be efficiently used.

Other Embodiments

Figures 10, 11:
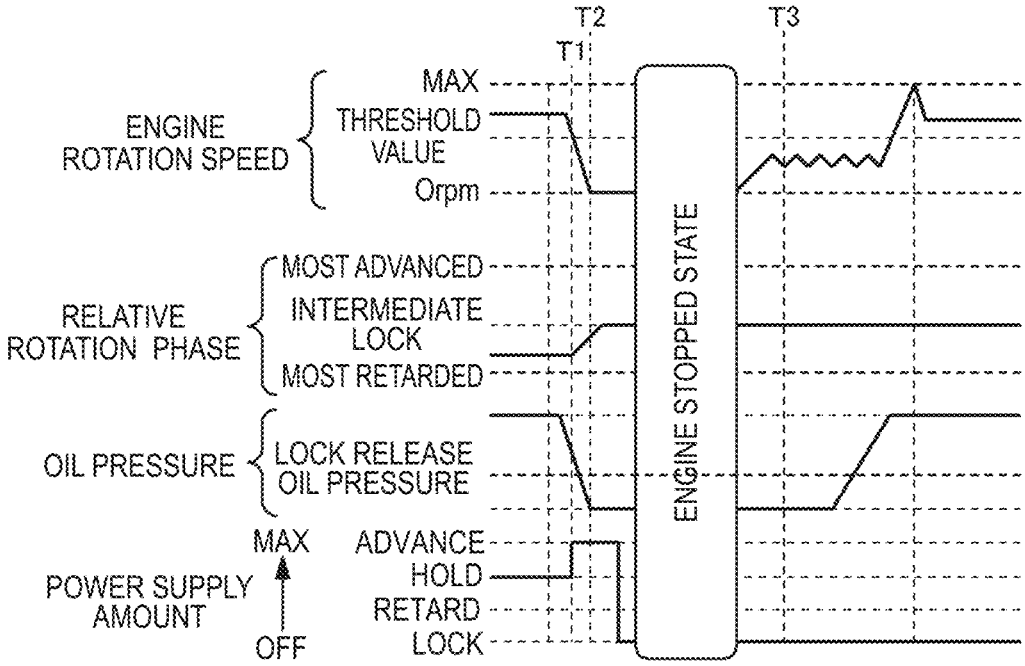
FIG. 10 is a diagram listing a relationship between a position of a spool and supply and discharge of working oil according to the other embodiment.
FIG. 11 is a time chart showing a control operation of a relative rotation phase according to the other embodiment.

Instead of the above embodiment, as shown in FIG. 10, a first retard position PB1 (an example of a first position), a second retard position PB2 (an example of a second position), a neutral position PN (an example of the second position), and an advance position PA (an example of the second position) may be provided in this order from a movement start position to a movement end position of the spool 55.

In the other embodiment, when a power supply amount to the electromagnetic control valve V is zero, a retard operation is performed to lock a lock mechanism L in a lock state. In the other embodiment, a control operation of a relative rotation phase by the phase control unit 71 at the time of engine stall will be described based on a time chart shown in FIG. 11.

In the example shown in FIG. 11, during the operation of the engine E, the electromagnetic control valve V is held in the neutral position PN and is in the lock release state. The relative rotation phase is held on a retard side with respect to the intermediate lock phase M. In the engine E operated in such a state, when the phase control unit 71 detects that an engine rotation speed is less than a threshold value based on an output from the engine rotation speed sensor 73 at a timing T1, the phase control unit 71 controls the power supply amount to the electromagnetic control valve V so that the relative rotation phase is displaced in the direction toward the intermediate lock phase M. Specifically, the power supply amount to the electromagnetic control valve V is maximized, and the spool 55 is moved to the advance position PA. Accordingly, the relative rotation phase is operated toward the advance direction Sa and thus is toward the intermediate lock phase M. At this time, since oil pressure in the supply flow path 8 is lower than lock release oil pressure with the engine stall of the engine E, the relative rotation phase is displaced to the intermediate lock phase M at a timing T2 after a predetermined time from the timing T1 or thereafter, and is in the lock state. In the control shown in FIG. 11, when the power supply to the electromagnetic control valve V is continued even after the engine E is stopped and the phase detection sensor 75 detects that the relative rotation phase is not displaced from the intermediate lock phase M, the phase control unit 71 determines that the relative rotation phase is locked at the intermediate lock phase M, and sets the power supply amount to the electromagnetic control valve V to zero.

In FIG. 11, at a timing T3 when the engine E is restarted and is in a cranking state after the engine E is left in the stopped state and the relative rotation phase is detected, since the relative rotation phase is locked at the intermediate lock phase M, the phase control unit 71 maintains the power supply amount to the electromagnetic control valve V at zero and maintains the relative rotation phase restrained to the intermediate lock phase M.

The control operation of the relative rotation phase by the phase control unit 71 at the time of restarting the engine E after the engine stall in the other embodiment will be described based on a time chart shown in FIG. 12. In the time chart shown in FIG. 12, when the engine stall occurs in the engine E, the phase control unit 71 performs control to increase (for example, maximize) the power supply amount to the electromagnetic control valve V and move the spool 55 to the advance position PA. However, since the power supply to the electromagnetic control valve V is stopped due to the stop of the engine E, it is assumed that the relative rotation phase cannot be displaced to the intermediate lock phase M.

When the engine E is restarted in this way, the electromagnetic control valve V is held in a lock position of the first retard position PB1, and the relative rotation phase is held on the retard side with respect to the intermediate lock phase M.

Figure 12:
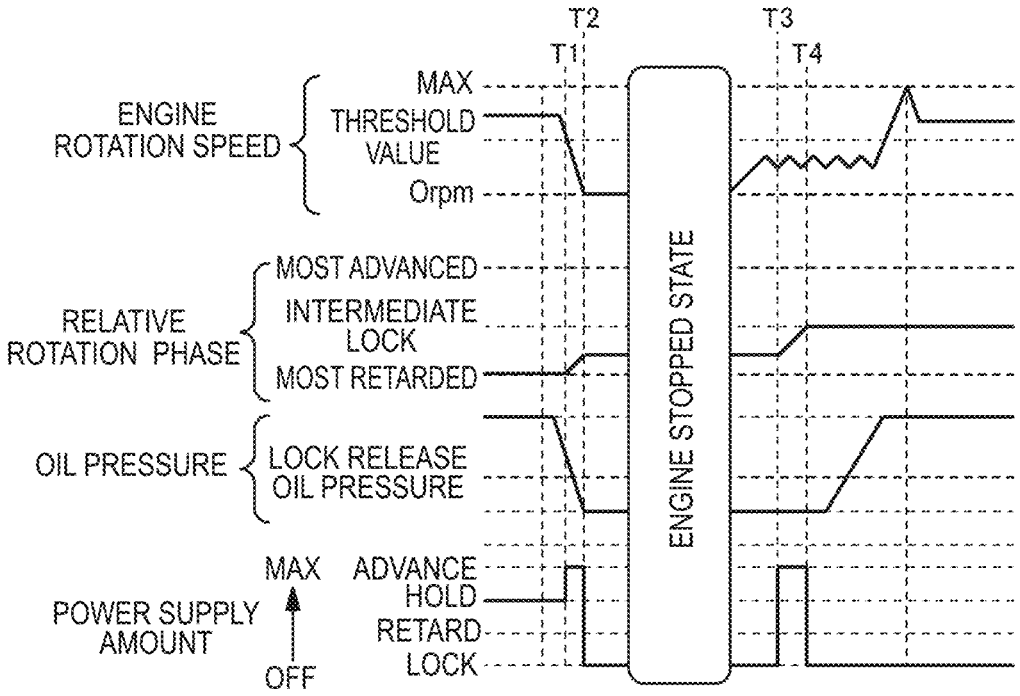
FIG. 12 is a time chart showing the control operation of the relative rotation phase according to the other embodiment.

In FIG. 12, at a timing T3 when the engine E is restarted and in the cranking state, if the phase control unit 71 detects that the relative rotation phase is not at the intermediate lock phase M based on the output from the phase detection sensor 75, the phase control unit 71 controls the power supply amount to the electromagnetic control valve V so that the relative rotation phase is displaced in the direction toward the intermediate lock phase M. Specifically, the power supply amount to the electromagnetic control valve V is increased (for example, maximized), and the spool 55 is moved to the advance position PA. Here, the relative rotation phase is displaced in the advance direction Sa under influence of a ratchet groove (not shown) separately provided in the internal rotor 30 and a cam fluctuation torque of the intake camshaft 5 by cranking. Further, since the spool 55 is moved to the advance position PA, the working oil is discharged from the retard chamber Cb. Accordingly, the relative rotation phase tends to be displaced in the advance direction Sa and thus is toward the intermediate lock phase M. At this time, since the engine E is started immediately, the oil pressure in the supply flow path 8 is lower than the lock release oil pressure. Therefore, the relative rotation phase is displaced to the intermediate lock phase M at a timing T4 after an elapse of a predetermined time from the timing T3, and is in the lock state.

Accordingly, for example, even if the relative rotation phase is not restrained to the intermediate lock phase M when the engine is stopped due to the engine stall or the like of the engine E, when the engine E is restarted, the relative rotation phase can be quickly displaced to the intermediate lock phase M. As a result, the combustion of the engine E can be started in the state in which the relative rotation phase is locked at the intermediate lock phase M. The startability at the time of starting the engine E can be ensured.

The first and other embodiments disclose that the phase control unit 71 is configured to perform both the control before the engine stall of the engine E (the control shown in FIGS. 8 and 11) and the control at the time of starting the engine E after the engine stall (the control shown in FIGS. 9 and 12). However, the phase control unit 71 may be configured to control only one of the control before the engine stall of the engine E and the control at the time of starting the engine E after the engine stall.

Embodiments disclosed here can be used in a valve opening and closing timing control device that controls a relative rotation phase between a drive-side rotary body and a driven-side rotary body by fluid pressure.

A characteristic configuration of a valve opening and closing timing control device according to an aspect of this disclosure resides in that the valve opening and closing timing control device includes: a drive-side rotary body that rotates synchronously with a crankshaft of an internal combustion engine; a driven-side rotary body that is arranged coaxially with a rotation axis of the drive-side rotary body and that rotates integrally with a valve opening and closing camshaft of the internal combustion engine; a fluid pressure chamber defined between the drive-side rotary body and the driven-side rotary body; an advance chamber and a retard chamber defined by partitioning the fluid pressure chamber with a partition portion provided in at least one of the drive-side rotary body and the driven-side rotary body; an intermediate lock mechanism that selectively switches between a lock state in which a relative rotation phase of the driven-side rotary body with respect to the drive-side rotary body is restrained to an intermediate lock phase between a most advanced phase and a most retarded phase and a lock release state in which the restraint of the intermediate lock phase is released by supply and discharge of a working fluid; an advance flow path that allows a flow of the working fluid to be supplied to and discharged from the advance chamber; a retard flow path that allows a flow of the working fluid to be supplied to and discharged from the retard chamber; a control valve including a spool that is in a first position when a power supply amount is zero and is moved to a second position different from the first position when the power is supplied; and a phase control unit that moves a position of the spool by controlling the power supply amount to the control valve to supply the working fluid to and discharge the working fluid from the advance chamber and the retard chamber to displace the relative rotation phase. When the spool is in the first position, the intermediate lock mechanism is set to the lock state and a state in which the working fluid is discharged from any one of the advance chamber and the retard chamber and the working fluid is supplied to the other one of the advance chamber and the retard chamber. When the spool is in the second position, the intermediate lock mechanism is set to the lock release state and a state in which the working fluid is supplied to any one of the advance chamber and the retard chamber and the working fluid is discharged from the other one of the advance chamber and the retard chamber. When the intermediate lock mechanism is in the lock release state and the relative rotation phase is a phase that is displaced in a direction toward the intermediate lock phase when the power supply amount to the control valve is maximized, and if a rotation speed of the internal combustion engine becomes less than a predetermined value, the phase control unit controls the power supply amount to the control valve so that the relative rotation phase is displaced in the direction toward the intermediate lock phase.

When an engine stall occurs in a vehicle equipped with the valve opening and closing timing control device, the internal combustion engine (which means an internal combustion engine for a vehicle. Hereinafter, referred to as an "engine") is stopped in a fairly short time without an engine stop command. Therefore, the relative rotation phase cannot be locked at the intermediate lock phase when the engine is stopped.

For example, when the rotation speed of the internal combustion engine (engine) becomes less than the predetermined value and the engine stall occurs, the power supply amount goes to zero if the power is supplied to the control valve. Therefore, when the engine stall occurs when the intermediate lock mechanism is in the lock release state and the relative rotation phase is a phase that is displaced in the direction toward the intermediate lock phase when the power supply amount to the control valve is zero, since the relative rotation phase is displaced toward the intermediate lock phase, the relative rotation phase may be at the intermediate lock phase when the internal combustion engine is stopped.

On the other hand, when the engine stall occurs when the intermediate lock mechanism is in the lock release state and the relative rotation phase is a phase that is displaced in the direction toward the intermediate lock phase when the power supply amount to the control valve is maximized, the relative rotation phase may be displaced toward a side opposite to the intermediate lock phase instead of being displaced toward the intermediate lock phase. Therefore, the relative rotation phase is not changed to the intermediate lock phase when the internal combustion engine is stopped.

Therefore, in this configuration, when the intermediate lock mechanism is in the lock release state and the relative rotation phase is the phase that is displaced in the direction toward the intermediate lock phase when the power supply amount to the control valve is maximized, and if the rotation speed of the internal combustion engine becomes less than the predetermined value, the phase control unit controls the power supply amount to the control valve so that the relative rotation phase is displaced in the direction toward the intermediate lock phase. That is, if the rotation speed of the internal combustion engine becomes less than the predetermined value, the phase control unit detects that the internal combustion engine is in a state toward the engine stall, and controls the power supply amount to the control valve. Specifically, the phase control unit increases the power supply amount to the control valve so that the relative rotation phase is displaced toward the intermediate lock phase. In this way, when the engine stall occurs in the internal combustion engine, by increasing the power supply amount to the control valve, the relative rotation phase, which is the phase displaced in the direction toward the intermediate lock phase, can be displaced to the intermediate lock phase. At this time, with the engine stall, the rotation speed of a hydraulic pump that supplies the working fluid to the intermediate lock mechanism also decreases. Pressure of the working fluid flowing through the supply flow path is lower than minimum pressure for maintaining the lock release state. Therefore, the relative rotation phase can be in the lock state when the relative rotation phase is displaced to the intermediate lock phase. As a result, since the internal combustion engine is stopped in a state in which the intermediate lock mechanism is shifted to the lock state, the startability at the time of restarting the internal combustion engine can be improved.

Another characteristic configuration resides in that, at a time of starting the internal combustion engine, when the intermediate lock mechanism is in the lock release state and the relative rotation phase is a phase that is displaced in a direction toward the intermediate lock phase when the power supply amount to the control valve is maximized, the phase control unit controls the power supply amount to the control valve so that the relative rotation phase is displaced in the direction toward the intermediate lock phase.

In the valve opening and closing timing control device, due to a sudden stop of the internal combustion engine due to the engine stall, the relative rotation phase when the internal combustion engine is stopped may not be restrained to the intermediate lock phase. For example, when the relative rotation phase when the internal combustion engine is stopped is the phase that is displaced in the direction toward the intermediate lock phase when the power supply amount to the control valve is maximized, and if the power supply amount to the control valve is zero during cranking when the internal combustion engine is started, the relative rotation phase is not displaced toward the intermediate lock phase. Therefore, the internal combustion engine cannot be started at the intermediate lock phase.

Therefore, in this configuration, when the internal combustion engine is started and the intermediate lock mechanism is in the lock release state and the relative rotation phase is the phase that is displaced in the direction toward the intermediate lock phase when the power supply amount to the control valve is maximized, the phase control unit controls the power supply amount to the control valve so that the relative rotation phase is displaced in the direction toward the intermediate lock phase. Specifically, the phase control unit increases the power supply amount to the control valve so that the relative rotation phase is displaced toward the intermediate lock phase. Accordingly, even when the relative rotation phase when the internal combustion engine is stopped is not at the intermediate lock phase, the relative rotation phase can be quickly displaced to the intermediate lock phase during cranking when the internal combustion engine is started. At this time, since the internal combustion engine is started immediately, the pressure of the working fluid in the supply flow path is lower than minimum pressure for maintaining the lock release state. Therefore, the relative rotation phase is displaced to the intermediate lock phase, and is in the lock state. As a result, since the combustion of the internal combustion engine can be started in the state where the intermediate lock mechanism is shifted to the lock state, the startability at the time of starting the internal combustion engine can be ensured.

A characteristic configuration of a valve opening and closing timing control device according to another aspect of this disclosure resides in that the valve opening and closing timing control device includes: a drive-side rotary body that rotates synchronously with a crankshaft of an internal combustion engine; a driven-side rotary body that is arranged coaxially with a rotation axis of the drive-side rotary body and that rotates integrally with a valve opening and closing camshaft of the internal combustion engine; a fluid pressure chamber defined between the drive-side rotary body and the driven-side rotary body; an advance chamber and a retard chamber defined by partitioning the fluid pressure chamber with a partition portion provided in at least one of the drive-side rotary body and the driven-side rotary body; an intermediate lock mechanism that selectively switches between a lock state in which a relative rotation phase of the driven-side rotary body with respect to the drive-side rotary body is restrained to an intermediate lock phase between a most advanced phase and a most retarded phase and a lock release state in which the restraint of the intermediate lock phase is released by supply and discharge of a working fluid; an advance flow path that allows a flow of the working fluid to be supplied to and discharged from the advance chamber; a retard flow path that allows a flow of the working fluid to be supplied to and discharged from the retard chamber; a control valve including a spool that is in a first position when a power supply amount is zero and is moved to a second position different from the first position when the power is supplied; and a phase control unit that moves a position of the spool by controlling the power supply amount to the control valve to supply the working fluid to the advance chamber and the retard chamber to displace the relative rotation phase. When the spool is in the first position, the intermediate lock mechanism is set to the lock state and a state in which the working fluid is discharged from any one of the advance chamber or the retard chamber and the working fluid is supplied to the other one of the advance chamber or the retard chamber. When the spool is in the second position, the intermediate locking mechanism is set to the lock release state. At a time of starting the internal combustion engine, when the intermediate lock mechanism is in the lock release state and the relative rotation phase is a phase that is displaced in a direction toward the intermediate lock phase when the power supply amount to the control valve is maximized, the phase control unit controls the power supply amount to the control valve so that the relative rotation phase is displaced in the direction toward the intermediate lock phase.

In this configuration, when the internal combustion engine is started and the intermediate lock mechanism is in the lock release state and the relative rotation phase is the phase that is displaced in the direction toward the intermediate lock phase when the power supply amount to the control valve is maximized, the phase control unit controls the power supply amount to the control valve so that the relative rotation phase is displaced in the direction toward the intermediate lock phase. Specifically, the phase control unit increases the power supply amount to the control valve so that the relative rotation phase is displaced toward the intermediate lock phase. Accordingly, even when the relative rotation phase when the internal combustion engine is stopped is not at the intermediate lock phase, the relative rotation phase can be quickly displaced to the intermediate lock phase during cranking when the internal combustion engine is started. At this time, since the internal combustion engine is started immediately, the pressure of the working fluid in the supply flow path is lower than minimum pressure for maintaining the lock release state. Therefore, the relative rotation phase is displaced to the intermediate lock phase, and is in the lock state. As a result, since the combustion of the internal combustion engine can be started in the state where the intermediate lock mechanism is shifted to the lock state, the startability at the time of starting the internal combustion engine can be ensured.

Another characteristic configuration resides in that, when the spool is in the second position, the intermediate lock mechanism is set to the state in which the working fluid is supplied to any one of the advance chamber and the retard chamber and the working fluid is discharged from the other one of the advance chamber and the retard chamber. When the intermediate lock mechanism is in the lock release state and the relative rotation phase is a phase that is displaced in a direction toward the intermediate lock phase when the power supply amount to the control valve is maximized, and if a rotation speed of the internal combustion engine becomes less than a predetermined value, the phase control unit controls the power supply amount to the control valve so that the relative rotation phase is displaced in the direction toward the intermediate lock phase.

In this configuration, when the intermediate lock mechanism is in the lock release state and the relative rotation phase is the phase that is displaced in the direction toward the intermediate lock phase when the power supply amount to the control valve is maximized, and if the rotation speed of the internal combustion engine becomes less than the predetermined value, the phase control unit controls the power supply amount to the control valve so that the relative rotation phase is displaced in the direction toward the intermediate lock phase. That is, when the rotation speed of the internal combustion engine becomes less than the predetermined value, the phase control unit detects that the internal combustion engine is in a state toward the engine stall, and controls the power supply amount to the control valve. Specifically, the phase control unit increases the power supply amount to the control valve so that the relative rotation phase is displaced toward the intermediate lock phase. In this way, when the engine stall occurs in the internal combustion engine, by increasing the power supply amount to the control valve, the relative rotation phase, which is the phase displaced in the direction toward the intermediate lock phase, can be displaced to the intermediate lock phase. At this time, with the engine stall, the rotation speed of the hydraulic pump that supplies the working fluid to the intermediate lock mechanism also decreases, and pressure of the working fluid flowing through the supply flow path is lower than minimum pressure for maintaining the lock release state. Therefore, the relative rotation phase can be in the lock state when the relative rotation phase is displaced to the intermediate lock phase. As a result, since the internal combustion engine is stopped in a state in which the intermediate lock mechanism is shifted to the lock state, the startability at the time of restarting the internal combustion engine can be improved.

Another characteristic configuration resides in that, when the intermediate lock mechanism is in the lock release state and the relative rotation phase is a phase that is displaced in a direction toward the intermediate lock phase when the power supply amount to the control valve is maximized, and if a fluid pressure of the working fluid becomes less than a predetermined value, the phase control unit controls the power supply amount to the control valve so that the relative rotation phase is displaced in the direction toward the intermediate lock phase.

According to this configuration, when the fluid pressure of the working fluid becomes less than the predetermined value, the phase control unit detects that the internal combustion engine is in a state toward the engine stall and controls the power supply amount to the control valve so that the relative rotation phase is displaced in the direction toward the intermediate lock phase. In the internal combustion engine, the fluid pressure of the working fluid decreases as the engine rotation speed decreases. Therefore, by detecting that the fluid pressure of the working fluid becomes less than the predetermined value in addition to the decrease in the rotation speed of the internal combustion engine, the occurrence of the subsequent engine stall can be accurately predicted. Accordingly, the phase control unit can control the power supply amount to the control valve at an appropriate timing to displace the relative rotation phase to the intermediate lock phase. As a result, the startability at the time of starting the internal combustion engine can be improved.

Another characteristic configuration resides in that a check valve is provided in a supply flow path of the working fluid.

According to this configuration, the working fluid does not flow back from the supply flow path due to the presence of the check valve. Therefore, when the engine stall occurs in the internal combustion engine, or when the internal combustion engine is started, even if the fluid pressure pump is not rotating and the fluid pressure of the working fluid upstream of the check valve decreases, the working fluid can be efficiently used inside the valve opening and closing timing control device.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control device comprising:

a drive-side rotary body that rotates synchronously with a crankshaft of an internal combustion engine;

a driven-side rotary body that is arranged coaxially with a rotation axis of the drive-side rotary body and that rotates integrally with a valve opening and closing camshaft of the internal combustion engine;

a fluid pressure chamber defined between the drive-side rotary body and the driven-side rotary body;

an advance chamber and a retard chamber defined by partitioning the fluid pressure chamber with a partition portion provided in at least one of the drive-side rotary body and the driven-side rotary body;

an intermediate lock mechanism that selectively switches between a lock state in which a relative rotation phase of the driven-side rotary body with respect to the drive-side rotary body is restrained to an intermediate lock phase between a most advanced phase and a most retarded phase and a lock release state in which the restraint of the intermediate lock phase is released by supply and discharge of a working fluid;

an advance flow path that allows a flow of the working fluid to be supplied to and discharged from the advance chamber;

a retard flow path that allows a flow of the working fluid to be supplied to and discharged from the retard chamber;

a control valve including a spool that is in a first position when a power supply amount is zero and is moved to a second position different from the first position when the power is supplied; and a phase control unit that moves a position of the spool by controlling the power supply amount to the control valve to supply the working fluid to and discharge the working fluid from the advance chamber and the retard chamber to displace the relative rotation phase, wherein when the spool is in the first position, the intermediate lock mechanism is set to the lock state and a state in which the working fluid is discharged from any one of the advance chamber and the retard chamber and the working fluid is supplied to the other one of the advance chamber and the retard chamber, when the spool is in the second position, the intermediate lock mechanism is set to the lock release state and a state in which the working fluid is supplied to any one of the advance chamber and the retard chamber and the working fluid is discharged from the other one of the advance chamber and the retard chamber, and when the intermediate lock mechanism is in the lock release state and the relative rotation phase is a phase that is displaced in a direction toward the intermediate lock phase when the power supply amount to the control valve is maximized, and if a rotation speed of the internal combustion engine becomes less than a predetermined value, the phase control unit controls the power supply amount to the control valve so that the relative rotation phase is displaced in the direction toward the intermediate lock phase.

2. The valve opening and closing timing control device according to claim 1, wherein at a time of starting the internal combustion engine, when the intermediate lock mechanism is in the lock release state and the relative rotation phase is a phase that is displaced in a direction toward the intermediate lock phase when the power supply amount to the control valve is maximized, the phase control unit controls the power supply amount to the control valve so that the relative rotation phase is displaced in the direction toward the intermediate lock phase.

3. The valve opening and closing timing control device according to claim 1, wherein when the intermediate lock mechanism is in the lock release state and the relative rotation phase is a phase that is displaced in a direction toward the intermediate lock phase when the power supply amount to the control valve is maximized, and if a fluid pressure of the working fluid becomes less than a predetermined value, the phase control unit controls the power supply amount to the control valve so that the relative rotation phase is displaced in the direction toward the intermediate lock phase.

4. The valve opening and closing timing control device according to claim 2, wherein when the intermediate lock mechanism is in the lock release state and the relative rotation phase is a phase that is displaced in a direction toward the intermediate lock phase when the power supply amount to the control valve is maximized, and if a fluid pressure of the working fluid becomes less than a predetermined value, the phase control unit controls the power supply amount to the control valve so that the relative rotation phase is displaced in the direction toward the intermediate lock phase.

5. The valve opening and closing timing control device according to claim 1, wherein a check valve is provided in a supply flow path of the working fluid.

6. The valve opening and closing timing control device according to claim 2, wherein a check valve is provided in a supply flow path of the working fluid.

7. The valve opening and closing timing control device according to claim 3, wherein a check valve is provided in a supply flow path of the working fluid.

8. A valve opening and closing timing control device comprising:

a drive-side rotary body that rotates synchronously with a crankshaft of an internal combustion engine;

a driven-side rotary body that is arranged coaxially with a rotation axis of the drive-side rotary body and that rotates integrally with a valve opening and closing camshaft of the internal combustion engine;

a fluid pressure chamber defined between the drive-side rotary body and the driven-side rotary body;

an advance chamber and a retard chamber defined by partitioning the fluid pressure chamber with a partition portion provided in at least one of the drive-side rotary body and the driven-side rotary body;

an intermediate lock mechanism that selectively switches between a lock state in which a relative rotation phase of the driven-side rotary body with respect to the drive-side rotary body is restrained to an intermediate lock phase between a most advanced phase and a most retarded phase and a lock release state in which the restraint of the intermediate lock phase is released by supply and discharge of a working fluid;

an advance flow path that allows a flow of the working fluid to be supplied to and discharged from the advance chamber;

a retard flow path that allows a flow of the working fluid to be supplied to and discharged from the retard chamber;

a control valve including a spool that is in a first position when a power supply amount is zero and is moved to a second position different from the first position when the power is supplied; and a phase control unit that moves a position of the spool by controlling the power supply amount to the control valve to supply the working fluid to the advance chamber and the retard chamber to displace the relative rotation phase, wherein when the spool is in the first position, the intermediate lock mechanism is set to the lock state and a state in which the working fluid is discharged from any one of the advance chamber and the retard chamber and the working fluid is supplied to the other one of the advance chamber and the retard chamber, when the spool is in the second position, the intermediate locking mechanism is set to the lock release state, and at a time of starting the internal combustion engine, when the intermediate lock mechanism is in the lock release state and the relative rotation phase is a phase that is displaced in a direction toward the intermediate lock phase when the power supply amount to the control valve is maximized, the phase control unit controls the power supply amount to the control valve so that the relative rotation phase is displaced in the direction toward the intermediate lock phase.

9. The valve opening and closing timing control device according to claim 8, wherein when the spool is in the second position, the intermediate lock mechanism is set to the state in which the working fluid is supplied to any one of the advance chamber and the retard chamber and the working fluid is discharged from the other one of the advance chamber and the retard chamber; and when the intermediate lock mechanism is in the lock release state and the relative rotation phase is a phase that is displaced in a direction toward the intermediate lock phase when the power supply amount to the control valve is maximized, and if a rotation speed of the internal combustion engine becomes less than a predetermined value, the phase control unit controls the power supply amount to the control valve so that the relative rotation phase is displaced in the direction toward the intermediate lock phase.

10. The valve opening and closing timing control device according to claim 9, wherein when the intermediate lock mechanism is in the lock release state and the relative rotation phase is a phase that is displaced in a direction toward the intermediate lock phase when the power supply amount to the control valve is maximized, and if a fluid pressure of the working fluid becomes less than a predetermined value, the phase control unit controls the power supply amount to the control valve so that the relative rotation phase is displaced in the direction toward the intermediate lock phase.

11. The valve opening and closing timing control device according to claim 8, wherein a check valve is provided in a supply flow path of the working fluid.

12. The valve opening and closing timing control device according to claim 9, wherein a check valve is provided in a supply flow path of the working fluid.

* * * * *